US006363965B1

(12) United States Patent
Carmack et al.

(10) Patent No.: US 6,363,965 B1
(45) Date of Patent: Apr. 2, 2002

(54) MANIFOLD ASSEMBLY

(75) Inventors: Johnny C. Carmack, Murfreesboro; Norman Gregory Beaty, Smyrna, both of TN (US)

(73) Assignees: Eaton Aeroquip Inc., Cleveland, OH (US); International Comfort Products, Lewisburg, TN (US)

( * ) Notice: Subject to any disclaimer, the term of this patent is extended or adjusted under 35 U.S.C. 154(b) by 0 days.

(21) Appl. No.: 09/744,897

(22) PCT Filed: Aug. 24, 1999

(86) PCT No.: PCT/US99/19349

§ 371 Date: Mar. 27, 2001

§ 102(e) Date: Mar. 27, 2001

(87) PCT Pub. No.: WO00/11383

PCT Pub. Date: Mar. 2, 2000

Related U.S. Application Data

(60) Provisional application No. 60/097,805, filed on Aug. 25, 1998.

(51) Int. Cl.[7] ..... F16K 11/07

(52) U.S. Cl. ..... 137/513.3; 137/561 A; 62/324.6

(58) Field of Search ..... 137/512, 513.3, 137/561 A; 62/324.6

(56) References Cited

U.S. PATENT DOCUMENTS

| | | | | |
|---|---|---|---|---|
| 2,158,792 A | | 5/1939 | Erbach | |
| 2,171,407 A | | 8/1939 | Shrode | |
| 2,237,239 A | | 4/1941 | Smith | |
| 3,151,676 A | | 10/1964 | Otto et al. | |
| 3,805,825 A | | 4/1974 | Lovingham | |
| 3,864,938 A | | 2/1975 | Hayes, Jr. | |
| 3,976,128 A | | 8/1976 | Patel et al. | |
| 3,992,898 A | | 11/1976 | Duell et al. | |
| 4,009,592 A | | 3/1977 | Boerger | |
| 4,359,877 A | * | 11/1982 | Coyne | 62/324.6 X |
| 4,367,638 A | * | 1/1983 | Gray | 62/324.6 |
| 4,381,798 A | * | 5/1983 | Tobin et al. | 62/324.6 X |
| 4,394,816 A | * | 7/1983 | Voorhis | 62/324.6 X |
| 4,483,156 A | * | 11/1984 | Oudenhoven | 62/324.6 X |
| 4,593,539 A | | 6/1986 | Humpolik | |
| 4,896,696 A | | 1/1990 | Bradley et al. | |
| 5,038,579 A | | 8/1991 | Drucker | |
| 5,056,560 A | | 10/1991 | DeMartelaere | |
| 5,265,438 A | * | 11/1993 | Knowles et al. | 62/324.6 |
| 5,290,152 A | * | 3/1994 | Wallace et al. | 62/324.6 |
| 5,345,780 A | * | 9/1994 | Aaron et al. | 62/324.6 |
| 5,507,468 A | * | 4/1996 | Evans | 137/513.3 X |
| 5,689,972 A | * | 11/1997 | Schuster et al. | 137/513.3 X |
| 5,894,741 A | * | 4/1999 | Durham et al. | 137/513.3 X |
| 5,950,575 A | * | 9/1999 | Simons et al. | 137/561 A X |

OTHER PUBLICATIONS

International Search Report dated Feb. 1, 2000 of PCT/US99/19349 corresponding to this application.

Aeroquip Engineering: FD20 Flow Control Literature, 1 page.

* cited by examiner

*Primary Examiner*—John Rivell
*Assistant Examiner*—Meredith H. Schoenfeld
(74) *Attorney, Agent, or Firm*—Emch, Schaffer, Schaub & Porcello Co., L.P.A.

(57) ABSTRACT

A manifold assembly for use with a heating and cooling system having a body, at least one connecting tube positioned adjacent the body and a fluid regulating device positioned in each connecting tube. The body defines a first passageway for flow of a fluid, such as refrigerant, in a first direction and a second direction. Each of the connecting tubes defines a second passageway for flow of the refrigerant in the first and second directions. The first and second passageways are in communication with one another. The regulating device regulates flow of the refrigerant through the first and second passageways in the first and second directions.

8 Claims, 3 Drawing Sheets

MANIFOLD ASSEMBLY

This application is a 371 of PCT/US99/19349, filed Aug. 24, 1999, which claims benefit of Provisional application Ser. No. 60/097,805, filed Aug. 25, 1998.

BACKGROUND OF THE INVENTION

The present invention relates generally to a manifold assembly. More specifically, the invention is directed to a manifold assembly that regulates the flow of fluid in heating and cooling equipment, such as a heat pump system.

In known heat pump systems, bi-flow thermal expansion valves are used to meter a fluid, such as a refrigerant, to a remote distributor with capillary tubes to feed the evaporator and the condenser coils in the system. Some prior art systems use fixed restrictors staked in the legs of manifolds in each evaporator and condenser coil. Each restrictor leg manifold is then connected with a valve to a non-restrictor leg manifold also attached to the evaporator and condenser coils so that when the reverse flow occurs, the proper regulation or metering is achieved for each respective refrigerant flow direction.

The present invention has many advantages over prior art manifold assemblies. First, the present invention provides a single manifold assembly for cooling. Second, the present invention provides for optimum refrigerant-to-coil surface transfer. This allows for the reduction in the size of the coil. These advantages decrease the amount of material needed in the heat pump system.

SUMMARY OF THE INVENTION

The manifold assembly of the present invention includes a body defining a first passageway for flow of a fluid in a first direction and a second direction. The assembly further includes at least one connecting tube positioned adjacent the body. The tube defines a second passageway for flow of the fluid in the first and second directions. The first and second passageways are in communication with one another. The assembly further includes a regulation device positioned in the second fluid passageway of the connecting tube. The regulating device regulates flow of the fluid through the first and second passageways in the first and second directions.

It is the primary object of the present invention to provide a manifold assembly that can regulate the flow of fluid in a first direction and a second direction.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
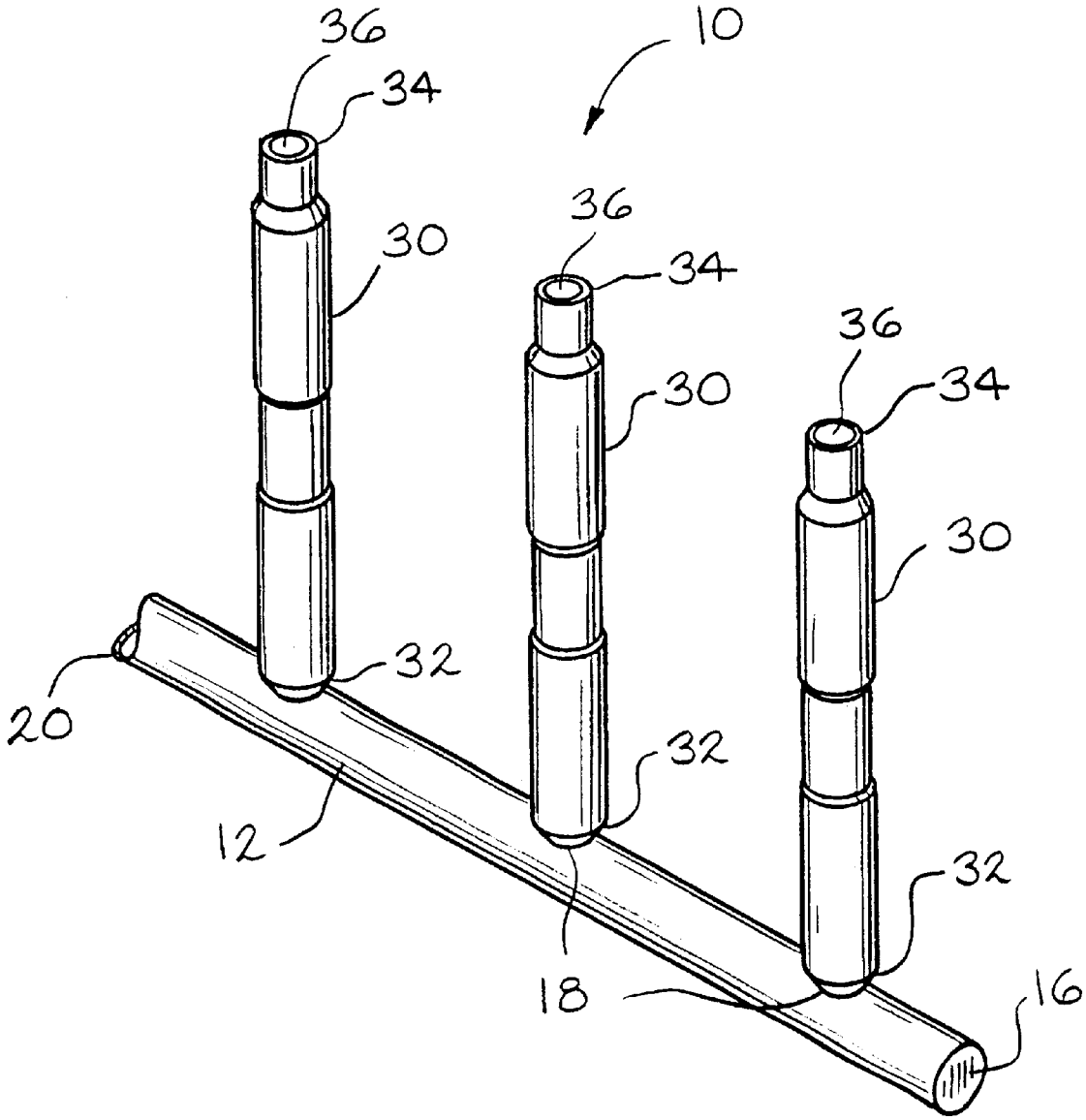
FIG. 1 is a perspective view of a portion of a manifold assembly according to the present invention.

The preferred embodiments and best mode of the present invention will now be described in detail with reference being made to the drawings. The manifold assembly of the present invention is indicated generally in the drawings by the reference number "10".

Figure 2:
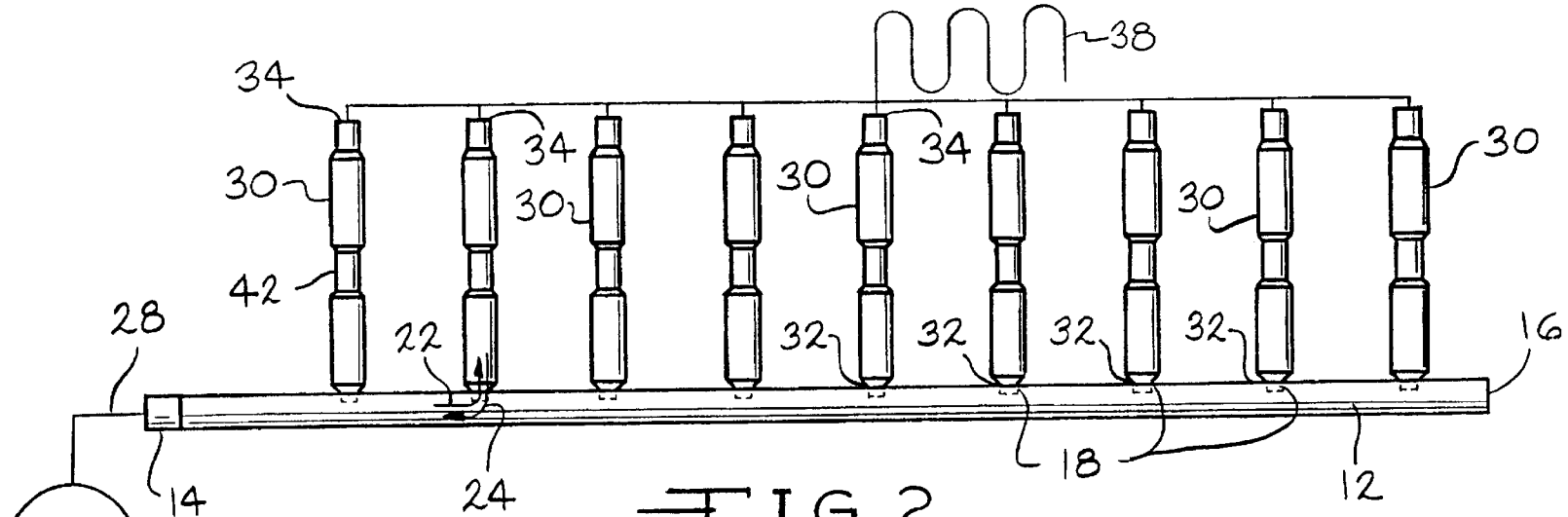
FIG. 2 is a front elevational view of a first embodiment manifold assembly according to the present invention.

Referring to FIGS. 1 and 2, the manifold assembly 10 includes a body 12 having an open end 14, a closed end 16 and a plurality of connecting tube openings 18. The body 12 defines a first passageway 20 that extends between the open and closed ends 14 and 16. The first passageway 20 is in communication with the connecting tube openings 18. The first passageway 20 allows for flow of a fluid, such as a refrigerant, in a first direction as shown by an arrow 22 and a second reverse direction as shown by an arrow 24.

Referring to FIG. 2, the open end 14 of the body 12 is in communication with, for example, a compressor 26 of a conventional heat pump system. The open end 14 is connected to the compressor 26 by, for example, a line or lines 28.

Referring again to FIGS. 1 and 2, the manifold assembly 10 includes a plurality of connecting tubes 30. In the present embodiment, there are nine generally straight connecting tubes 30. However, the number and shape of the connecting tubes can vary depending on the type of system used with the assembly 10.

Still referring to FIGS. 1 and 2, each of the connecting tubes 30 includes a first end 32 and second end 34. Each of the first and second ends 32 and 34 are open. Each of the connecting tubes 30 defines a second passageway 36 that provides for flow of the refrigerant in the first direction as indicated by the arrow 22 and in the second direction as indicated by the arrow 24.

As shown in FIG. 2, the first ends 32 of the connecting tubes 30 are mounted on the body 12 at their respective connective tube openings 18. This allows for fluid communication between the first and second passageways 20 and 36. The second ends 34 of the connecting tubes 30 are directly connected to, for example, a condenser or an evaporator coil 38 of the conventional heat pump system. As it will be appreciated, this will allow for flow of the refrigerant between the compressor 26 and the coil 38 through the body 12 and connecting tubes 30 of the assembly 10.

Figure 3:
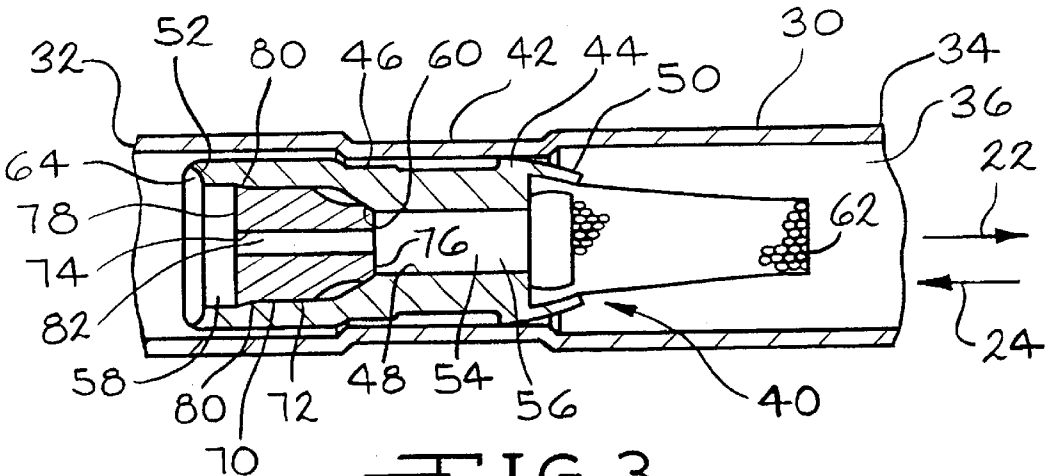
FIG. 3 is a detailed cross-sectional view of a regulating device according to the present invention which is positioned in a connecting tube.

Referring to FIG. 3, a regulating device 40 is positioned in each of the second passageways 36 of the connecting tubes 30. The regulating device 40 regulates flow of the refrigerant through the first and second passageways 20 and 36 in the first and second directions as indicated by the arrows 22 and 24. As shown in FIG. 3, the regulating device 40 is positioned in the connecting tube 30 at a narrowed midpoint portion 42 between the first and second ends 32 and 34.

Referring to FIG. 3, the regulating device 40 includes a cartridge 44 having an exterior surface 46, an interior surface 48, a first cartridge end 50 and a second cartridge end 52. The exterior surface 46 is adapted to snugly engage the connecting tube 30 in order to maintain the regulating device 40 in the second passageway 36.

Still referring to FIG. 3, the interior surface 48 defines a cartridge fluid passageway 54 extending between the first and second cartridge ends 50 and 52. The cartridge fluid passageway 54 includes a fluid portion 56 and a restrictor portion 58. The restrictor portion 58 has a larger diameter than the fluid portion 56. The interior surface 48 defines a restrictor shoulder 60 in the restrictor portion 58 adjacent the fluid portion 56.

As shown in FIG. 3, the first cartridge end 50 is adapted to receive a filter 62 to filter the refrigerant as it flows through the second passageway 36. The second cartridge end 52 is adapted to receive a restrictor washer 64.

Still referring to FIG. 3, the regulating device 40 further includes a restrictor 70 having a restrictor exterior surface 72, a restrictor interior surface 74, a restrictor first end 76 and a restrictor second end 78. The restrictor exterior surface 72 defines a contoured surface that corresponds to the shape of the restrictor portion 58 of the cartridge fluid passageway 54. The restrictor 70 includes longitudinally extending projections 80 that are in sliding engagement with the interior surface 48 of the cartridge 44. The restrictor first end 76 is adapted to engage the restrictor shoulder 60. The restrictor second end 78 is adapted to engage the restrictor washer 64. Accordingly, the restrictor 70 is moveable in the longitudinal direction in the restrictor portion 58 of the cartridge fluid passageway 54 between the restrictor shoulder 60 and the restrictor washer 64.

As shown in FIG. 3, the restrictor interior surface 74 defines an orifice 82 that extends longitudinally between the restrictor first end 76 and the restrictor second end 78. The orifice 82 is calibrated by having a predetermined size depending on the use of the assembly 10.

As shown in FIG. 3, when refrigerant is flowing through the second passageway 36 in the first direction as indicated by the arrow 22, the restrictor 70 moves in the first direction until the restrictor first end 76 engages the restrictor shoulder 60. This engagement prevents flow of the refrigerant around the restrictor exterior surface 72. Accordingly, the only flow path is through the calibrated orifice 82. When the refrigerant moves in the second direction, as indicated by the arrow 24, the restrictor 70 moves in the second direction until it engages the washer 64. This allows for the free-flow of the refrigerant around and through the restrictor 70 in the second direction.

In a preferred embodiment, the body 12 and the connecting tubes 30 are constructed of copper. The cartridge 44, the restrictor 70 and the restrictor washer 64 are constructed of brass. It should be understood that other materials can be used depending on the use of the assembly 10.

Figure 4:
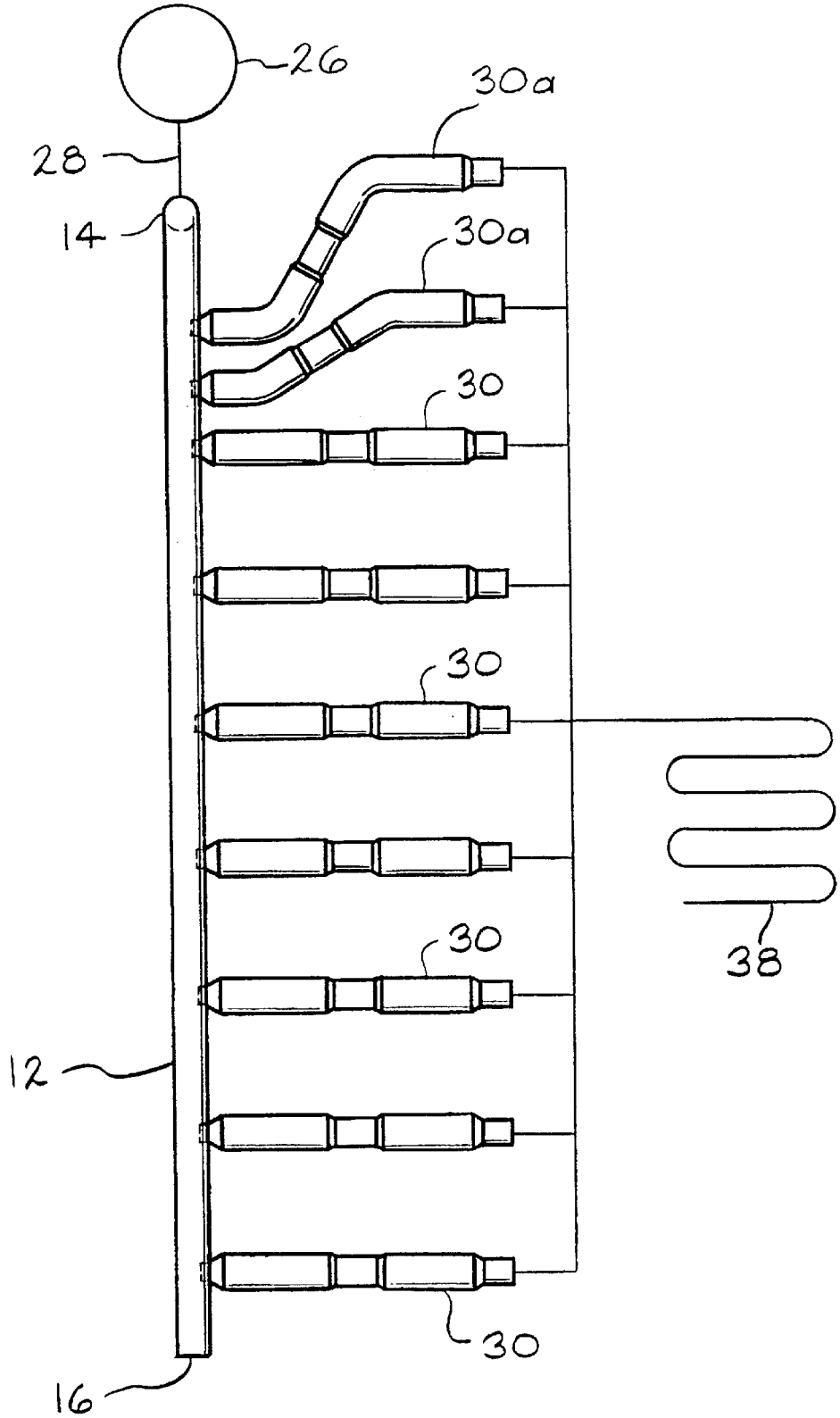
FIG. 4 is a front elevational view of a second embodiment manifold assembly according to the present invention.

Referring to FIG. 4, a second embodiment manifold assembly 110 is shown. The assembly 110 includes all of the elements previously described with respect to the first embodiment assembly 10. However, the second embodiment assembly 110 includes seven generally straight connecting tubes 30 and two generally curved connecting tubes 30*a*. The connecting tubes 30*a* have been adapted for a particular type coil 38. The function of the connecting tubes 30*a* are the same as for the connecting tubes 30.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A manifold assembly, comprising:

a body defining a first passageway for flow of a fluid in a first direction and a second direction;

a plurality of connecting tubes positioned adjacent said body, each of said connecting tubes defining a second passageway for flow of said fluid in said first and second directions, said first and second passageways being in communication with one another; and a regulating device positioned in each of said second passageways of said connecting tubes, each of said regulating devices including a cartridge defining a cartridge fluid passageway, a moveable restrictor having a calibrated orifice positioned in said cartridge fluid passageway, said restrictor restricting flow of said fluid through said orifice when said fluid is flowing in said first direction, said restrictor allowing free-flow of said fluid in said second direction.

2. The manifold assembly of claim 1, wherein said body includes an open end, a closed end and at least one connecting tube opening for receiving said connecting tube, said first passageway extending between said open and closed ends, said first passageway being in communication with said connecting tube opening.

3. The manifold assembly of claim 2, wherein said open end is connected to a source of said fluid.

4. The manifold assembly of claim 3, wherein said source of said fluid is a compressor.

5. The manifold assembly of claim 1, wherein each of said connecting tube includes a first end and a second end, said second passageway extending between said first and second ends.

6. The manifold assembly of claim 5, wherein said first end is mounted on said body.

7. The manifold assembly of claim 6, wherein said second end is connected to a coil.

8. The manifold assembly of claim 1, wherein each of said regulating devices includes a screen positioned adjacent said cartridge fluid passageway.

* * * * *